United States Patent [19]

Martin

[11] Patent Number: 4,516,299

[45] Date of Patent: May 14, 1985

[54] METHOD AND APPARATUS FOR MAKING SINGLE CRANKS FOR BUILT-UP CRANKSHAFTS USED IN LARGE ENGINES

[75] Inventor: Wayne A. Martin, Pittsburgh, Pa.

[73] Assignee: United States Steel Corporation, Pittsburgh, Pa.

[21] Appl. No.: 493,119

[22] Filed: May 9, 1983

[51] Int. Cl.[3] ..... B21K 1/08

[52] U.S. Cl. ..... 29/6; 72/377; 72/356

[58] Field of Search ..... 72/352, 356, 404, 405, 72/377; 29/6

[56] References Cited

U.S. PATENT DOCUMENTS

| | | | |
|---|---|---|---|
| 3,534,579 | 10/1970 | Robra | 72/377 |
| 4,306,342 | 12/1981 | Hansen | 29/6 |

FOREIGN PATENT DOCUMENTS

| | | | |
|---|---|---|---|
| 1042353 | 10/1958 | Fed. Rep. of Germany | 29/6 |
| 1133219 | 7/1962 | Fed. Rep. of Germany | 29/6 |
| 2651338 | 6/1977 | Fed. Rep. of Germany | 72/377 |
| 2932247 | 3/1981 | Fed. Rep. of Germany | 29/6 |
| 39553 | 4/1976 | Japan | 29/6 |
| 93764 | 8/1976 | Japan | 29/6 |
| 323183 | 11/1968 | U.S.S.R. | 29/6 |

*Primary Examiner*—Daniel C. Crane
*Assistant Examiner*—David B. Jones
*Attorney, Agent, or Firm*—William F. Riesmeyer, III

[57] ABSTRACT

A method is provided for making single crank throws for built-up crankshafts. The method includes heating an elongated workpiece having a saddle-shaped central area on one surface thereof and forming the workpiece into V-shape by pushing it with a punch into a first-forming die having legs angled between 35 and 65 degrees. The punch is V-shape with opposed surfaces inclined at substantially the same angle as the first-forming die. The workpiece is then reheated and pushed with a punch into a second-forming die having inwardly converging surfaces at an outer portion of the cavity and parallel sidewalls joining the inner end of the outer die surfaces. The apparatus includes a bottom die having a long generally rectangular cavity and top die punch rotatably mounted about a vertical axis on the underside of the press crosshead and a motor drive for rotating the top die punch to alternate positions for forging opposite halves of the workpiece in the lengthwise direction.

8 Claims, 15 Drawing Figures

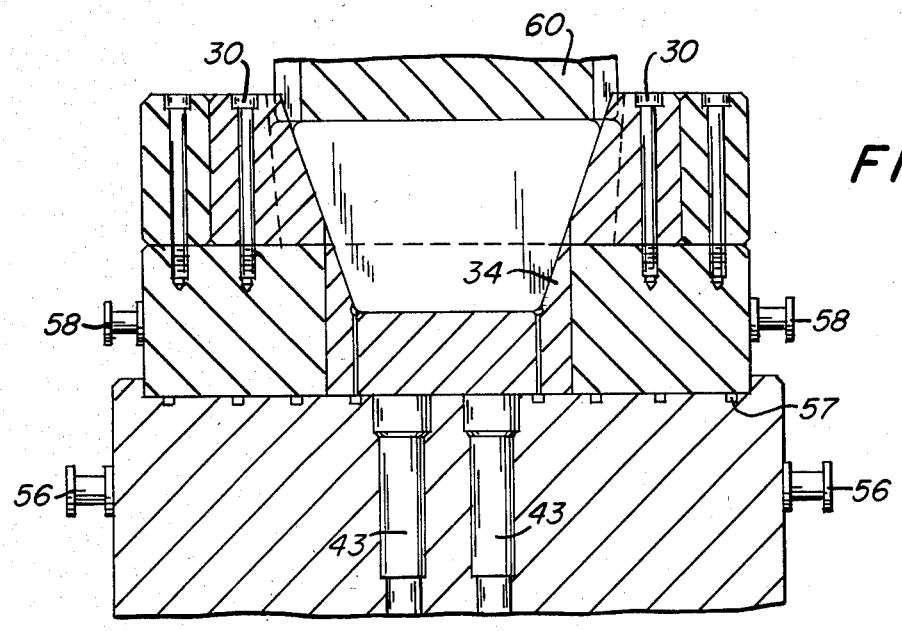
FIG. 3
FIG. 13
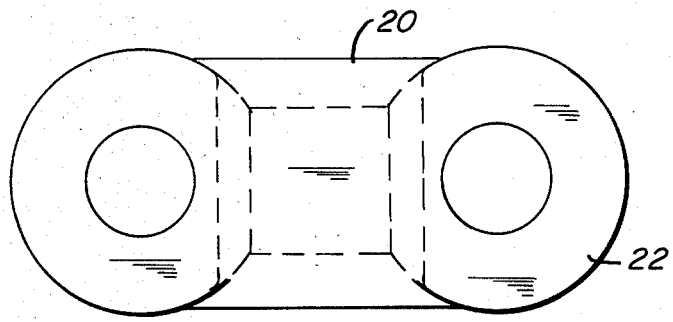
FIG. 15
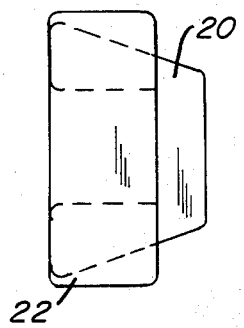
FIG. 14
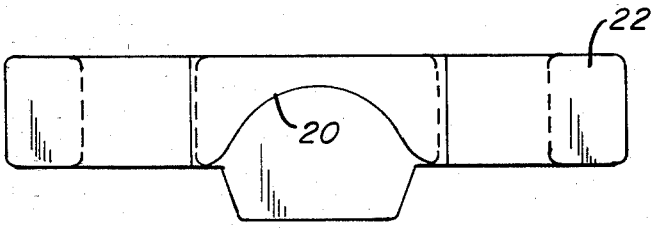

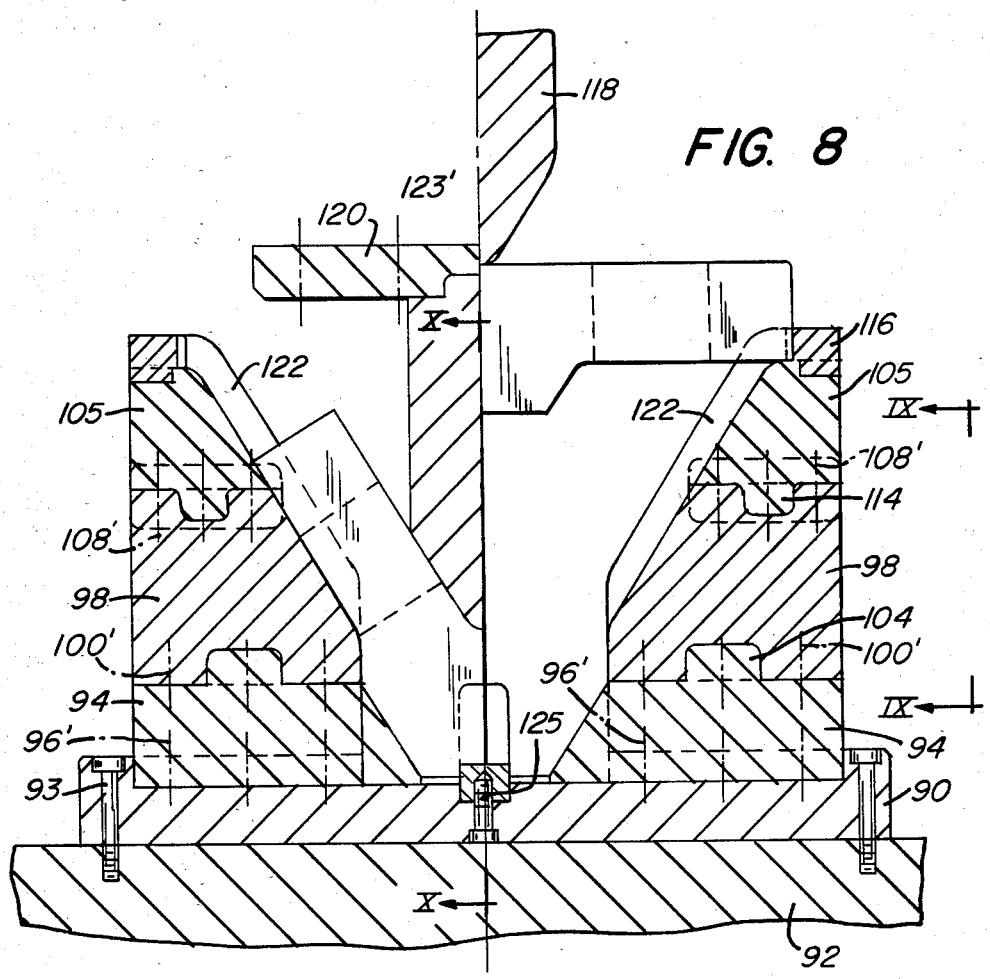
FIG. 8
FIG. 9
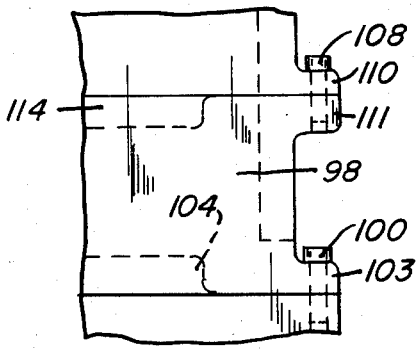

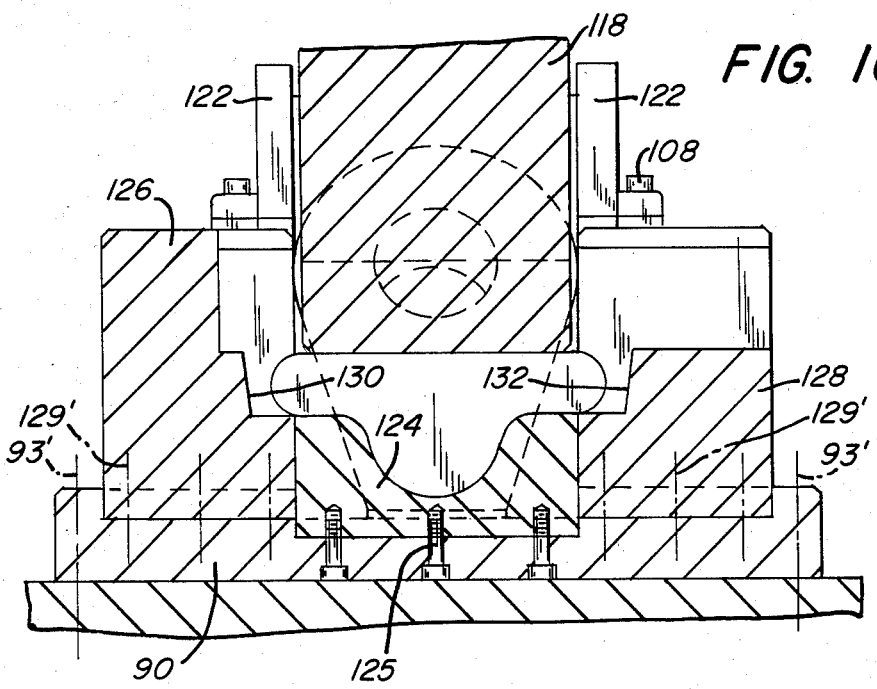
FIG. 10
FIG. 11
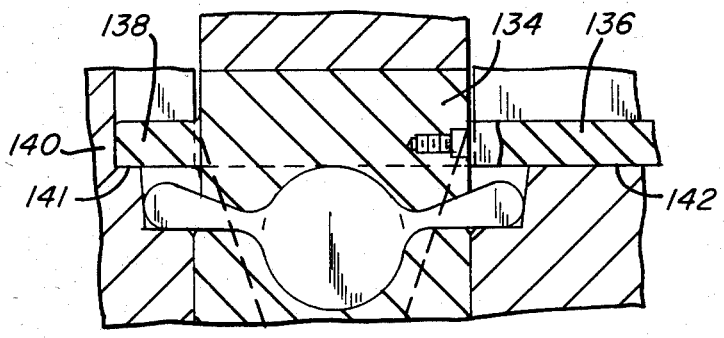

METHOD AND APPARATUS FOR MAKING SINGLE CRANKS FOR BUILT-UP CRANKSHAFTS USED IN LARGE ENGINES

BACKGROUND OF THE INVENTION

The present invention relates to a method and apparatus for making single cranks which are used to build-up crankshafts for large engines.

Crankshafts for ships' engines and other large engines are made from a plurality of single cranks and shaft sections. The cranks and shaft sections are assembled together to form a crankshaft. The number and size of cranks used in the built-up crankshaft is dependent upon the horsepower of the engine. Ships' engines may have an output of up to 50,000 horsepower. The cranks used in building-up crankshafts for these engines must also be very large. For example, each crank for a large engine crankshaft may weigh approximately 20 tons. The crank may be about 72-inches long and have a width of 54-inches and a crank arm thickness of 17.5-inches. Manufacture of such large cranks is difficult and in the past has required special equipment as well as considerable machining to obtain the finished shape and size.

A special rotary-hinge type apparatus is shown in Russian Pat. No. 323,183 for making large single cranks. A method using a similar apparatus is described in Japanese Examined Patent Application No. J76-93764. The cranks made on such apparatus are rough-shaped forgings and require considerable complex machining on large equipment due to the fact that most of the machining must be performewd on the final-shaped forging configuration.

It is therefore a primary object of the invention to provide a method of making more precise large single cranks on a conventional open-die press.

It is another object of the invention to provide a method for making large single cranks with significantly reduced final machining.

It is still another object of the invention to provide apparatus for forging very long horizontally elongated workpieces in a semi-closed die assembly on a conventional open-die press.

SUMMARY OF THE INVENTION

The present invention relates to a method of making single cranks which are adapted to be built-up into crankshafts for large engines, especially marine diesel engines. The cranks each have a pair of spaced generally parallel crank arms and an integral throw pin joining the crank arms. The method includes providing an elongated generally flat metal workpiece having longitudinal end portions of about the desired final thickness and shape of the crank arms. The central portion of the workpiece has a saddle-shaped area protruding from a lower broad face of the workpiece which is about the desired final shape of portions of the crank arms adjoining the throw pin. The term saddle-shaped as used herein is not limiting but merely refers to this desired final shape. The next step includes heating the workpiece to a suitable temperature for forming. The heated workpiece is formed into V-shape by forcing the workpiece into a first-forming die which has a V-shaped cavity. This is accomplished by lowering a top punch into an upper broad face of the central portion of the workpiece. The base of the cavity in the first-forming die has about the same shape as at least the outer peripheral portions of the saddle-shaped area of the workpiece. At least a major portion of the die cavity is defined by opposed sidewalls which are tilted upwardly from horizontal at equal angles within the range of from about 35 to about 65 degrees. The top punch has a V-shaped configuration at its lower end with opposed surfaces substantially parallel to the opposed sidewalls of the first-forming die. This prevents laps or creases from forming in the workpiece during forming. After forming to V-shape the workpiece is reheated again to a suitable temperature for the final forming opertion. The reheated workpiece is formed to a generally parallel arm configuration in a second-forming die. The second-forming die has a downwardly extending cavity which at the upper end has spaced opposed downwardly and inwardly sloped surfaces of substantially the same angle with respect to horizontal as the crank arms of the V-shaped workpiece. The lower portion of the cavity has generally parallel sidewalls joining spaced inner ends of the sloped upper die surfaces. The workpiece is pressed into the die by lowering a second top punch into the interior portion of the V-shaped workpiece.

It is desirable that the first-forming die have curved configurations at the upper ends of its opposed sloped surfaces which extend tangentially in a horizontal direction. The die preferably has spaced locators which provide proper initial positioning of the workpiece in the die so that lower edges of the longitudinal ends of the workpiece rest at about the point of tangency abovementioned. This permits the workpiece to slide more easily and to be formed without undesirable distortion especially during the initial stage of the forming operation. In preferred form, the second top punch has a convex curvature most preferably of semi-circular shape at its lower end. It is also desirable that the base of the cavity in the second-forming die have the same convex curvature, again preferably of semi-circular shape. The base of the cavity in the first-forming die may also have a similar configuration for beginning the formation of the throw pin. After forming the workpiece in the first-forming die, an auxiliary throw form punch may be placed between the first top punch and workpiece and then pressed into the workpiece to form the inner curved surface of the throw pin. The workpiece may be heated and reheated at 1800° to 2000° F. prior to forming in the first and second-forming dies, respectively. Finally, in preferred form the step of providing the elongated workpiece includes heating a metal slug and then forging the heated slug in an at least semi-closed die assembly which may be of the type presently to be described. The term slug is meant to include an ingot or previously rolled or forged elongated piece of metal having the desired volume for the die assembly used in the forging step. It is also desirable to punch holes of accurate position and size in the crank arms after forging, but before heating and forming of the workpiece. A particularly advantageous feature of the invention is that the holes retain their shape and are not deformed by the forming operation. Before the forming operation, the upper and lower broad longitudinal faces of the workpiece are preliminarily machined. This decreases the amount of final machining which is necessary in the more complex configuration and helps the workpiece to be more accurately located and guided in the forming dies. After preliminary machining, the workpiece may be sonic tested if required.

In another aspect the invention includes apparatus for forging a very long horizontally elongated workpiece in a semiclosed die in an open-die press. The die assembly includes a bottom die having bottom and sidewalls defining a horizontally elongated cavity. A top punch is mounted on the underside of the press crosshead and is axially rotatable about a vertical axis. A motor and drive means mounted on the crosshead are provided for selectively rotating the top die to alternate diametrically opposed positions. The bottom die is slidable back and forth to alternate positions so that opposite halves of the bottom die cavity are positioned beneath the top die. The top punch has a working surface covering at least slightly more than half the length of the bottom die cavity. An upwardly tapered surface of the top punch located adjacent the center of the bottom die cavity prevents laps from forming in the workpiece during forging.

BRIEF DESCRIPTION OF THE DRAWINGS

FIG. 3 is a section taken at III—III of FIG. 2.

FIG. 8 is a section taken at VIII—VIII of FIG. 7 showing on the right half of the drawing the top punch in raised position and on the left half the top punch in lowered position.

FIG. 9 is a view taken at IX—IX of FIG. 8.

FIG. 10 is a section taken at X—X of FIG. 8.

FIG. 11 is a partial section taken at X—X of FIG. 8 showing an auxiliary top punch positioned beneath the V-shaped top punch used with the first-forming die.

FIG. 13 is a plan view of the workpiece after forging and punching in the semi-closed die assembly of FIGS. 1 and 2.

FIG. 14 is a side elevation view of the workpiece shown in FIG. 13.

FIG. 15 is an end view of the workpiece shown in FIG. 13.

DESCRIPTION OF THE PREFERRED EMBODIMENT

Figure 1:
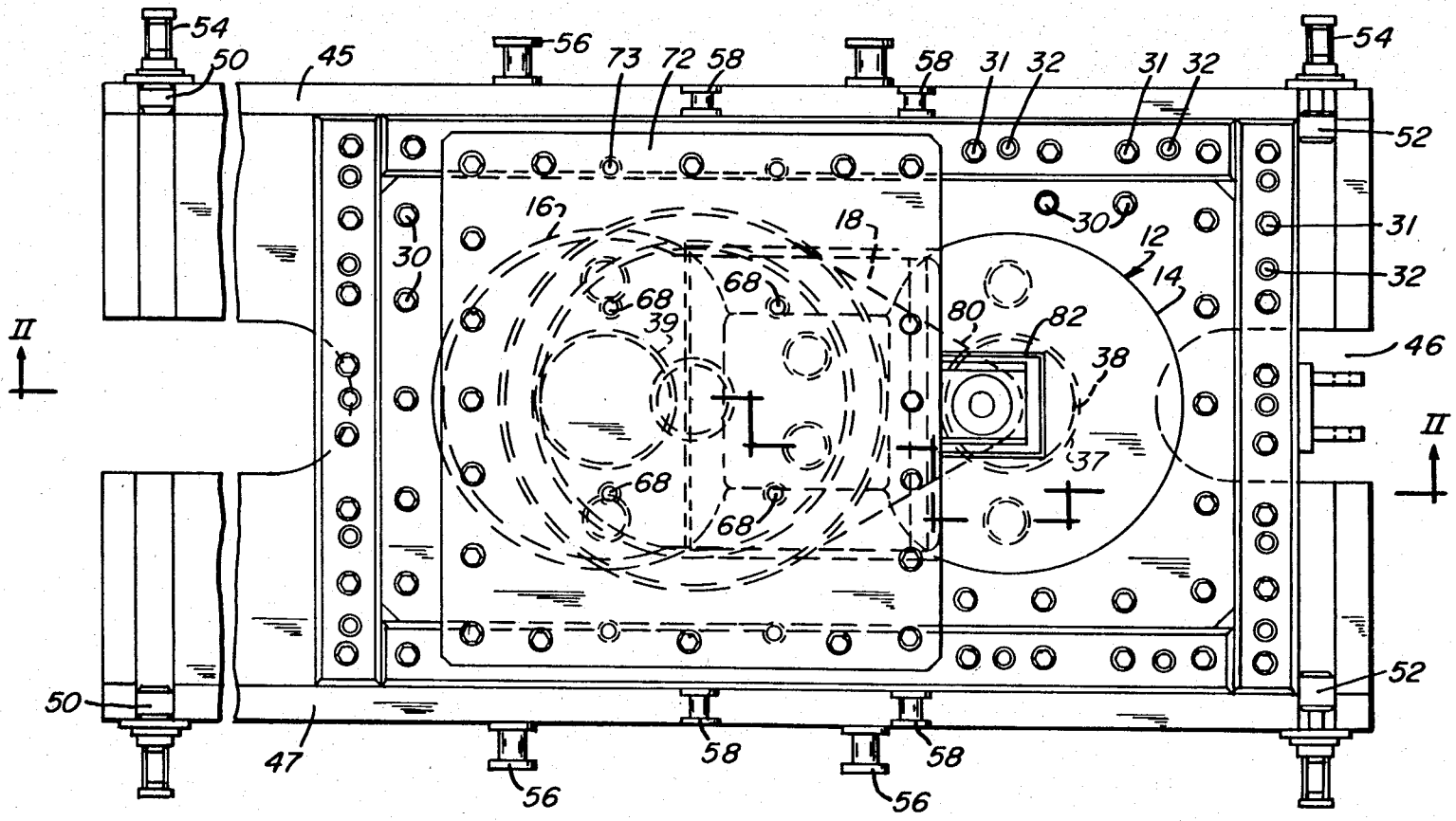
FIG. 1 is a plan view of the semi-closed die assembly for forging a large flat dogbone-shaped workpiece later to be formed into a crank configuration.
Figure 2:
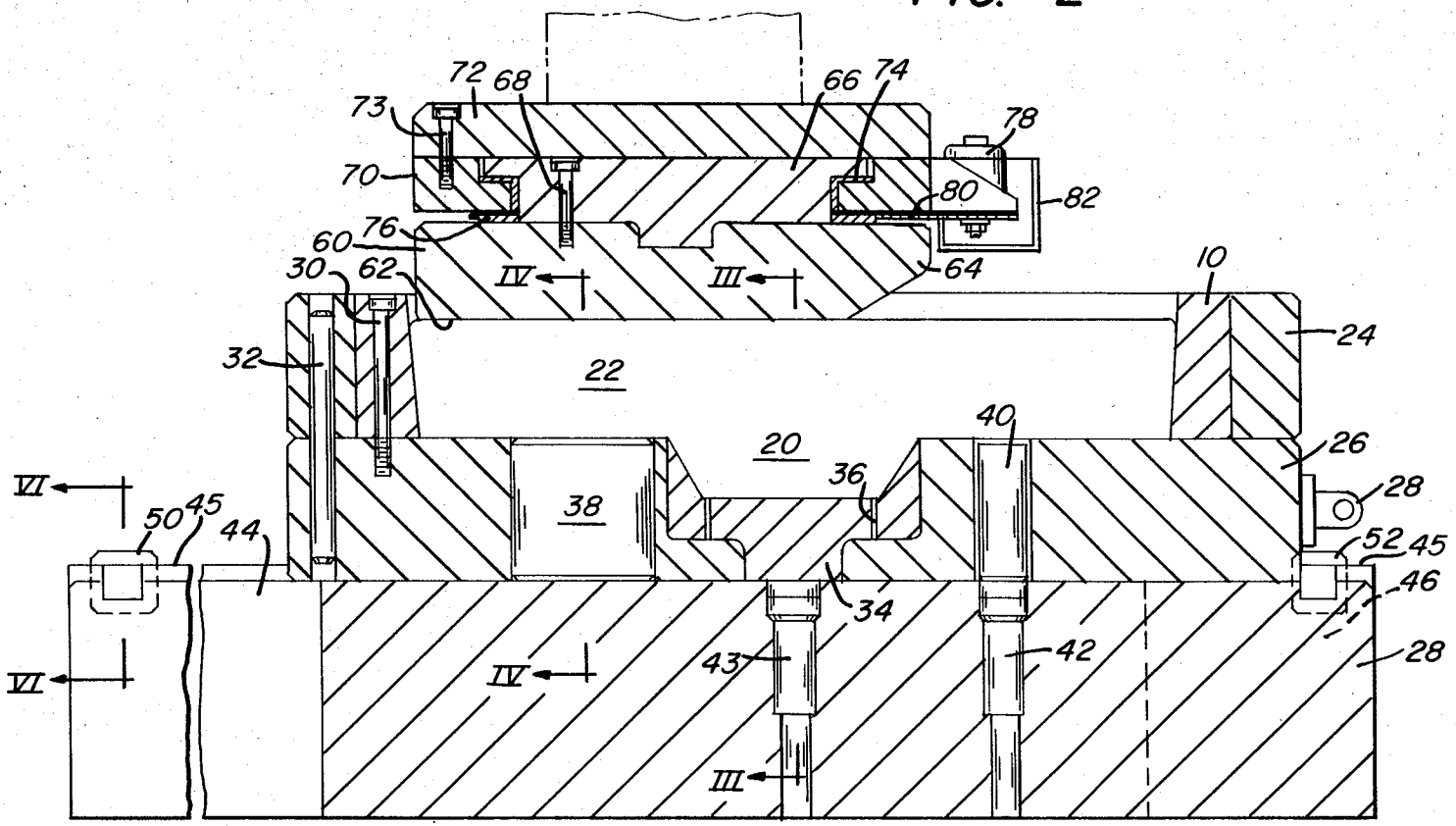
FIG. 2 is a section taken at II—II of FIG. 1.

In making a large single crank according to the method of this invention an ingot of SAE 1045 steel is cogged in the forge press to a rectangular shape of the proper volume. The metal slug is then reheated to forging temperature and placed in the semiclosed die assembly presently to be described. FIG. 2 shows a cross-sectional view of the entire die assembly for forging the slug into a dogbone-shaped workpiece. The assembly includes a bottom die 10 which has a dogbone-shaped cavity 12 (FIG. 1) with opposed outer end portions 14, 16 having the shape of crank arms and a central portion 18 which has a saddle-shaped area 20 on the lower broad face of the workpiece 22. The bottom die fits within a bottom die retainer 24. The retainer and bottom die are supported on the top surface of a bottom die holder 26 which in turn is supported by bottom riser 28. A plurality of bolts 30 are used to secure the bottom die to the holder 26. The retainer is similarly secured to the holder by a plurality of bolts 31 (FIG. 1). The retainer also has a plurality of dowel pins 32 press fit into holes in the retainer and holder for taking the bulk of outward forces exerted by the bottom die. The bottom die is easily replaceable so that dies for varying size workpieces may be interchanged in the retainer. A saddle-shaped insert 34 is provided in the bottom die and is slidable upwardly and downwardly therein for a purpose later described. The insert has a plurality of interconnected vent passages which permit escape of gas and enable complete filling of the saddle-shaped area during forging. The holder has a pair of spaced holes 37, 39 (FIG. 1) each of which slidablly receive a solid backup pin 38 (FIG. 2). Four (4) ejector pins 40 (FIGS. 1 and 2) are slidably mounted in the holder. Each ejector pin is abutted at its lower end by a hydraulic cylinder 42 located in the bottom riser for raising the pins and the workpiece to ease its removal from the die. A pair of hydraulic cylinders 43 (FIG. 1) are provided in the riser for raising the saddle-shaped insert 34 (FIG. 2) to also assist in raising the workpiece as just mentioned. The bottom riser is stationary and has opposed end slots 44, 46, each of which is adapted to receive one of the backup pins 38 when the holder 26 is moved slidably back and forth between guide-ways 45, 47 to positions where the backup pins are free to fall into the slots. Clevis 48 of the holder is engageable by a press pusher or hydraulic cylinder for moving the holder when it is desired to drop the backup pins after forging and prior to the punching operation as later described. Two (2) pair of stops 50, 52 are provided for determining alternate positions of the holder during forging. The stop pins are selectively advanced and retracted by hydraulic cylinder 54. Trunnions 56 are provided to enable lifting of the riser for die setup and handling. Similarly, trunnions 58 are provided on the bottom die for the same purposes. Longitudinal grooves 57 (FIG. 3) are provided in the riser which may be filled with oil or grease to lubricate and ease sliding movement of the holder.

An axially rotatable top die punch 60 is mounted on the press crosshead. The punch has a horizontal working surface 62 and an upwardly angled surface 64 for preventing laps or creases from forming in the workpiece during forging. The surface 64 is tilted at an angle of 5 to 45 preferably 15 to 35 degrees depending on the amount of deformation to be taken on each draft of the forge press. The top die punch is secured to punch bearing pin 66 by a plurality of bolts 68. The punch bearing pin is rotatably mounted in stationary top punch holder 70 which is secured to the top die mounting plate 72 by bolts 73. A bronze bushing ring 74 is provided between the holder 70 and pin 66. A sprocket 76 secured to pin 66 is rotated by motor 78 and chain drive 80. A metal heat shield and guard 82 protects the motor from exposure to radiation from the workpiece. The top die mounting plate is secured by bolts (not shown) in conventional fashion to the press ram or crosshead.

Figure 6:
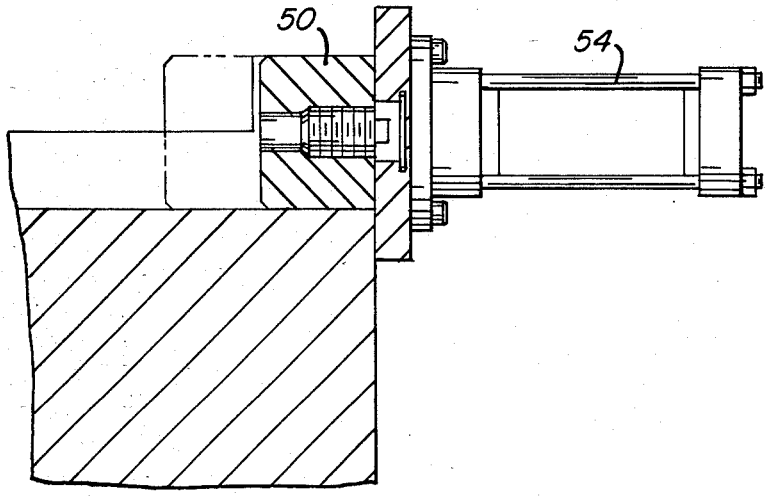
FIG. 6 is a section taken at VI—VI of FIG. 2.
Figure 4:
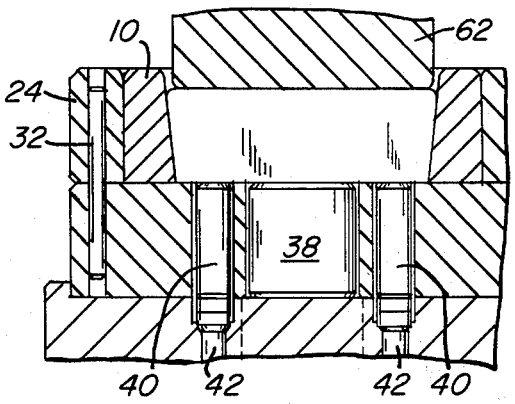
FIG. 4 is a section taken at IV—IV of FIG. 2 during forging of the workpiece.
Figure 5:
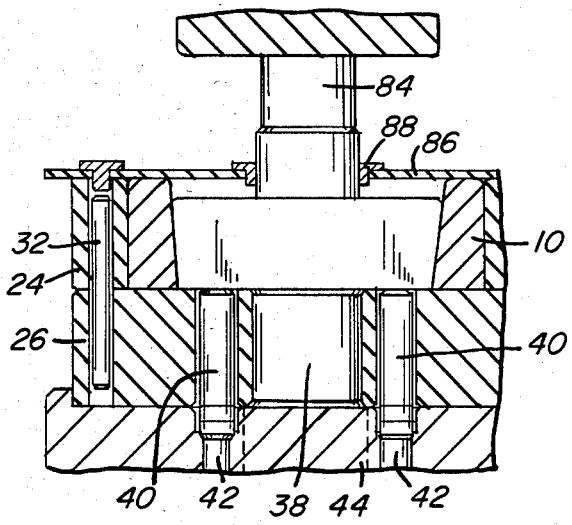
FIG. 5 is a section also at IV—IV of FIG. 2 taken during the step of punching holes through the workpiece.
Figure 7:
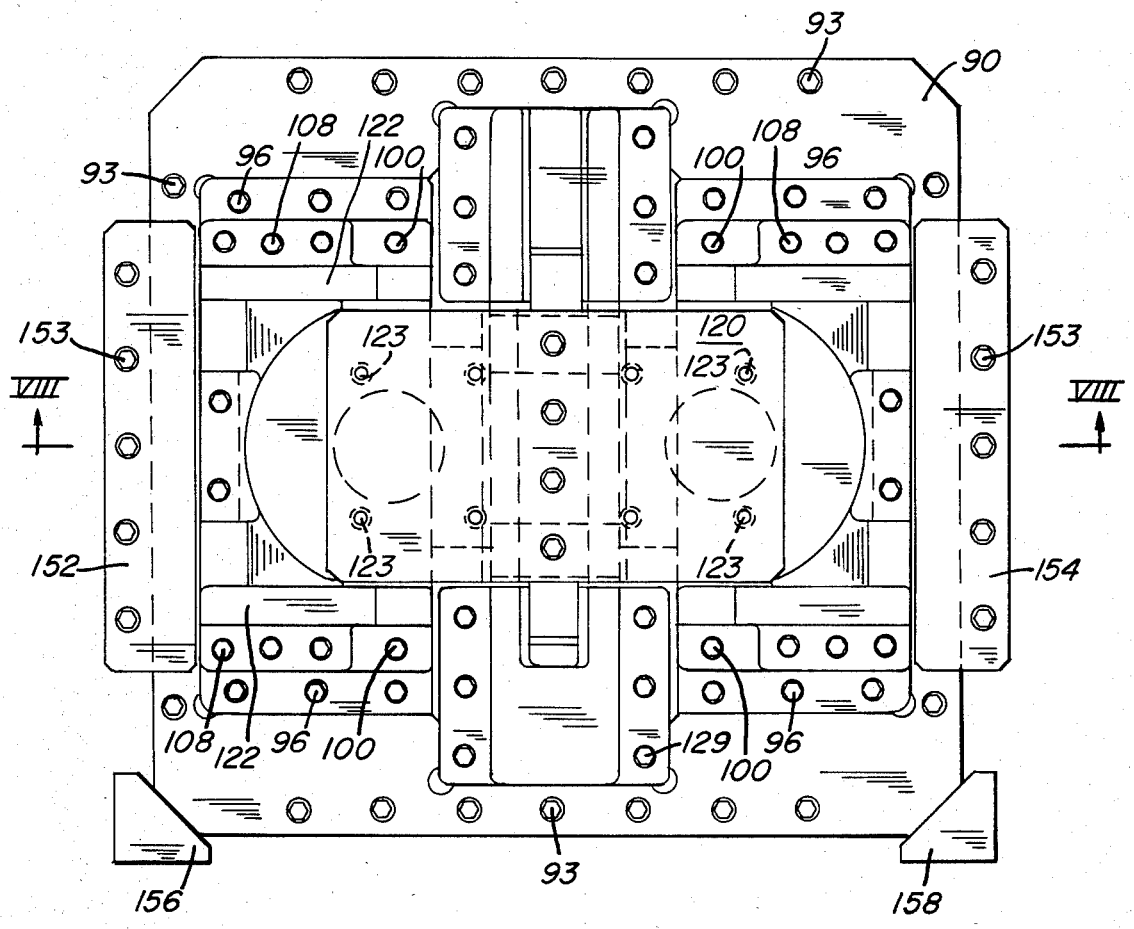
FIG. 7 is a plan view of the first-forming die for forming the workpiece into V-shape.

FIG. 3 shows more clearly the pair of hydraulic cylinders 43 for raising the replaceable insert 34 and thus with it the saddle-shaped portion of the workpiece to enable the workpiece to be lifted out of the die. Similarly, the ejector pins 40 located under one of the crank arm portions of the workpiece are shown in FIG. 4. FIG. 5 is the same section as FIG. 4 taken during the punching step after forging the workpiece to the dogbone-shape of the bottom die. A separate hot hole punch 84 is placed within the light metal locating fixture 86 which is positioned in the open portions of the holes for dowel pins 32. Interchangeable collars 88 of different size opening may be used for locating hot hole punches of various sizes. It should be noted that hole backup pin 38 has been dropped into slot 44 so that the core of metal punched from the workpiece will drop into the now empty hole in the holder where the backup pin was previously located. FIG. 6 shows detail of one of the stop pins 50 and the alternate positions of the pin in advance or retracted positions.

FIGS. 7–11 show the first-forming die assembly for performing the next operation on the flat dogbone-shaped workpiece which is to form it into V-shape. The first-forming die includes a bottom die holder 90 (FIG. 8) which is secured to the press base bolster 92 (FIG. 8) by bolts 93, also indicated by dashed lines 93' in FIG. 10. A pair of incline upright risers 94 are mounted on the holder and secured to the holder by bolts 96 (FIG. 7) located at dashed lines 96' in FIG. 8. On top of the risers 94 are a pair of lower incline uprights 98 which are bolted to the risers by bolts 100 (FIG. 7) at locations indicated by dashed lines 100' in FIG. 8. Bolts 100 are shown in FIG. 9 extending through flange 103 of the lower upright into the riser. To absorb outward horizontal forces the risers have a key 104 fitting in a mateable slot in the uprights 98. A pair of upper incline uprights 105 are secured in similar fashion on top of the lower incline uprights by bolts 108 (FIG. 9) extending through mateable flanges 110, 111 of the upper and lower uprights. The bolts are located at spaced positions 108' (FIG. 8). Again, a key 114 is provided in each upper upright fitting into a mateable slot in the lower upright therebeneath. A part locator 116 is bolted to each upper upright for assuring proper centering of the workpiece when it is placed in the die initially. A V-shaped top punch 118 is attached to a punch holder mounting plate 120 which in turn is secured to the press crosshead by bolts 123 (FIG. 7) at locations 123' indicated by dashed lines on FIG. 8. The punch is shown in a raised position on the right-hand side of FIG. 8 and lowered on the left-hand side of the same figure. The workpiece is guided in its downward forming movement by side guides 122.

FIG. 10 shows a section view through the cavity in the first-forming die at the base of the V therein. The workpiece is shown pressed downwardly filling the convex curvature of the throw form punch 124 which is bolted to the bottom die holder. On opposite sides of the throw form punch are left and right-hand side control supports 126, 128 which are pocketed and secured to the bottom die holder by bolts 129 (FIG. 7) at locations 129' in FIG. 10. These support pieces each have a recess 130, 132, respectively, allowing room for flashing to expand outwardly during the final stages of the forming operation when the outer curvature of the integral pin is being formed. FIG. 11 shows a part section taken at the same location after the forming operation with a top throw form punch. Auxiliary top form punch 134 is mounted in place beneath but not secured to the top punch. The auxiliary punch has a tapped hole for receiving the threaded pin of arm 136. The arm is held by a manipulator machine (not shown). The auxiliary punch has a V-shaped upper surface mateable with the lower surface of the top punch. An extension or locating projection 138 on the auxiliary punch serves to center the auxiliary punch over the workpiece and becomes abutted against shoulder 140 in the left-hand side control support. A conventional safety limit switch is located in the shoulder 141 for contact by the projection 138 to stop the press crosshead from proceeding to a lower position after the pin is formed to the rounded configuration. Surface 142 on the right-hand side support is at substantially the same elevation as shoulder 141.

Figure 12:
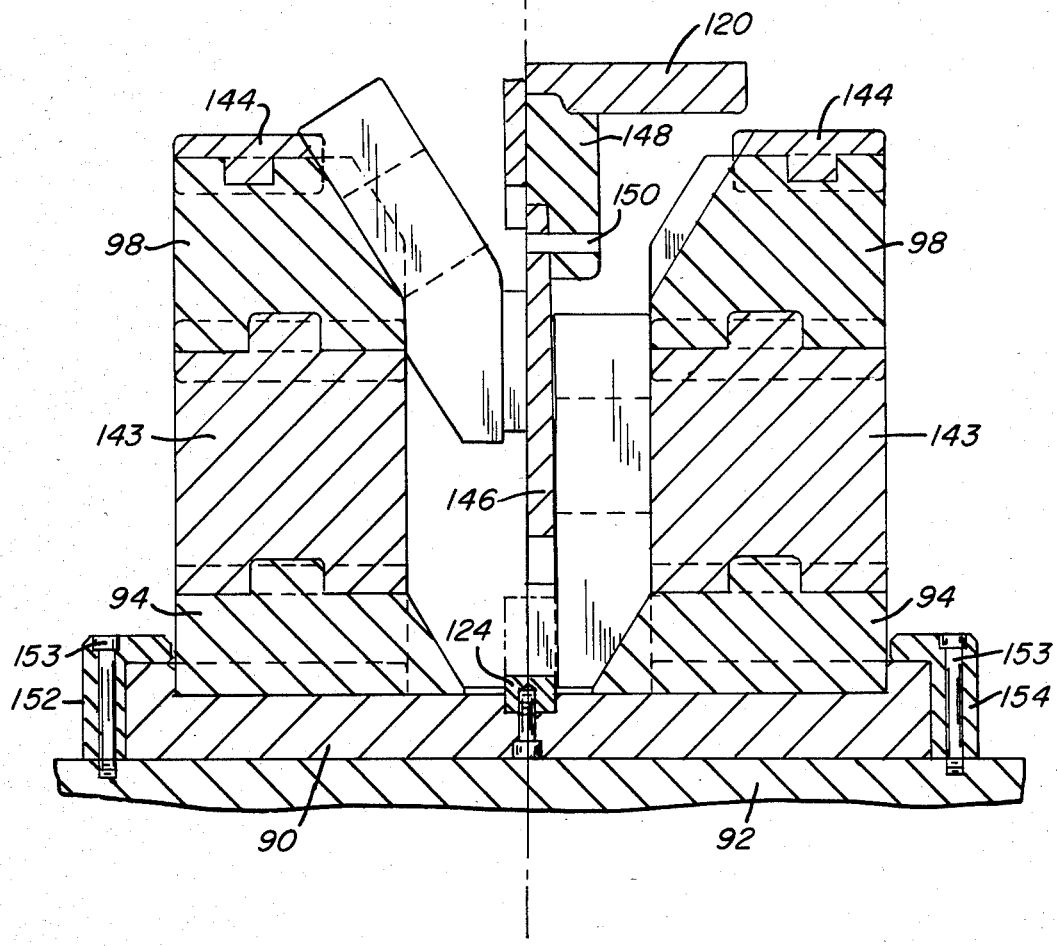
FIG. 12 is a cross-sectional view of the second-forming die for forming the legs of the V-shaped workpiece into parallel configuration.

FIG. 12 shows a cross-section of the second-forming die assembly for forming the workpiece after reheating from V-shape to the final parallel leg configuration. The assembly includes the same bottom die holder 90, throw-form punch 124 incline upright risers 94 and lower incline uprights 98 as used in the first-forming die. A pair of lower spacers 143 separate the incline upright risers from the lower incline uprights. A pair of caps 144 are provided on the top surface of the uprights to add additional incline height and protect the inner edge of the lower incline uprights from damage or wear. The pieces are all bolted and keyed together as previously described with respect to the first-forming die. Finally a top-form punch 146 is secured to a punch holder 148 by a press fit pin 150. The punch holder in turn is secured to the punch holder mounting plate 120. The top-form punch is shown in raised position on the left-hand side of FIG. 12 and in the lowered position on the right-hand side of the same figure. The top-form punch has a semi-circular convex surface adapted to complete formation of the round shape of the integral throw pin.

In some presses the clearance height between the crosshead and press base is not large enough to allow insertion of the workpiece in either the first or second-forming dies. In this case gibs 152, 154 shown on FIGS. 7 and 12 which are secured by bolts 153 to the press base bolster 92 and serve as guides for slidable movement of the entire die assemblies horizontally in and out of position under the press crosshead. Stops 156, 158 (FIG. 7) serve to properly locate the die holder and dies in position under the crosshead. Thus, to insert the workpiece in the dies, the entire holder and die assembly is slidably moved out of the press. After installation of the workpiece in the die, the holder and die assembly are then moved back into position in the press.

The sequence of operations is as follows: An ingot of SAE 1045 steel is heated and cogged in the forge press to a rectangular shape of the proper volume. The slug is then reheated to a forging temperature of about 2250° F. and placed in the bottom die 10 (FIGS. 1 and 2). The slug is pressed into dogbone-shape by alternate pressing of opposite halves of the workpiece by top die punch 60. FIG. 2 shows the position of the holder 26 abutted against extended stops 52 for pressing the left-hand side of the workpiece. To press the opposite half, the holder is slidably moved so as to abut stops 50 which are then extended. The top die punch is rotated 180° and then lowered so as to press the right-hand side of the workpiece as illustrated in FIG. 2. This sequence is repeated until the workpiece is forged into dogbone-shape filling the cavity in the bottom die. Immediately after forging, the stops 50 and 52 are retracted and the holder is slidably moved left and then right as in FIG. 2, beyond the location of the stops so as to drop backup pins 38 into slots 44 and 46 of the bottom riser 28. The holder is then moved to a center position and the stops 50 and 52 are again extended. The holder is moved into position abutting either pair of stops and the top die punch rotated to proper position over the bottom die in preparation for the punching operation. The hole locating fixture 86 is positioned in the retainer and a hot hole punch 84 is placed in the fixture. The top die punch is then lowered forming a hole in the workpiece and pushing the punch core into the vacant hole in the riser in which backup pin 38 was formerly located. To punch the second hole, the holder is moved slidably to abut the other pair of stops, the top die punch is rotated and the same sequence of placing the fixture and hot hole punch are repeated. After both holes are punched in the workpiece, cylinders 42 and 43 are extended raising the workpiece upwardly in the bottom die so that it may be removed from the die more easily. After forging and punching the upper and lower surfaces of the workpiece are preliminarily machined and the workpiece is sonic tested.

The workpiece is then reheated to a temperature within the range of 1800° to 2000° F. and placed in the first-forming die as shown on the right-hand portion of FIG. 8. The V-shaped punch 118 is then pressed into the workpiece forming it into the shape of the cavity in the first-forming die. FIG. 10 shows the configuration of the central portion of the workpiece at this stage where the bottom throw-form punch 124 creates a curvature in the outer portion of the integral pin of the crank throw. The top punch causes flashing to flow outwardly in the recesses 130, 132 of the left and right side control supports 126, 128. After this step the top punch is raised and auxiliary punch 134 is positioned beneath the top punch by a manipulator which grasps arm 136. The top punch is then lowered to begin formation of a curved configuration on the inner side of the pin section of the crank throw. The major portion of the flashing is removed prior to heating of the workpiece for the final-forming operation.

Finally, the V-shaped workpiece is reheated to a temperature between 1800° to 2000° F. and placed in the second-forming die as shown on the left-hand side of FIG. 12. The top-form punch 146 is then lowered so as to press the workpiece into parallel leg configuration. During this step the inner and outer surfaces of the pin section are formed to circular shape by the throw-form punch 124 and top-form punch 146. Thus, a large single crank with an integral throw is formed which requires only minimal final machining to arrive at the desired dimensions and finish.

I claim:

1. A method of making a crank having a pair of spaced generally parallel crank arms and an integral throw pin joining said arms, said method comprising:

(a) providing an elongated generally flat metal workpiece having longitudinal end portions of about the desired final thickness and shape of said crank arms and a central portion with a saddle-shaped area protruding from a lower broad face, thereof, (b) heating said workpiece to a temperature suitable for a first-forming operation, (c) placing the heated workpiece in a first-forming die so that lower edges of longitudinal ends of the workpiece rest substantially at the point of tangency in a horizontal direction of downwardly curved configurations at the upper ends of opposed sidewalls forming a V-shaped cavity in said die, and forming the heated workpiece by lowering a first top punch into an upper broad face of the central portion of the workpiece, bending the workpiece into the shape of the cavity in said die, said opposed sidewalls being tilted upwardly from horizontal at an angle within the range of about 35° to about 65°, the lower end of said top punch having opposed lower surfaces substantially parallel to said opposed sidewalls of the die, the base of said cavity in the die having a shape substantially the same as the saddle-shaped area of the workpiece, (d) reheating the V-shaped workpiece to a temperature suitable for a second-forming operation, and (e) forming the reheated workpiece to a generally parallel arm configuration by lowering a second-top punch into the upper broad face of the central workpiece portion forcing the workpiece into a second-forming die having a cavity extending downwardly therein, the upper portion of said cavity having opposed surfaces sloped downwardly and inwardly at substantially the same angle as the arms of the V-shaped workpiece, the lower portion of said cavity having generally parallel sidewalls joining the spaced inner ends of the sloped upper die surfaces.

2. The method of claim 1 wherein step (e) includes lowering a second top punch having a convex curved configuration at its lower end into the workpiece and forcing the workpiece into a second-forming die having a matching convex curved configuration at the base of the cavity therein.

3. The method of claim 1 wherein step (c) includes forcing the workpiece into a first-forming die having a cavity, the base of which includes a convex curved configuration for forming an outer side of the throw pin.

4. The method of claim 3 further comprising after forcing the workpiece into the first-forming die raising said first top punch and placing a throw form auxiliary punch having a convex curved surface on a lower face thereof between the workpiece and said top punch, and then lowering the top punch so as to press the auxiliary punch into the workpiece.

5. The method of claim 1 wherein step (b) includes heating the workpiece to a temperature within the range of from about 1800° to about 2000° F.

6. The method of claim 1 wherein step (e) includes reheating the V-shaped workpiece to a temperature within the range of from about 1800° to about 2000° F.

7. The method of claim 1 wherein step (a) includes heating a metal slug and then forging the heated slug in an at least semi-closed die assembly, said assembly including a bottom die having an elongated shallow cavity with opposed longitudinal end portions having the shape of said crank arms and a central portion defining said saddle-shaped area protruding from a lower broad face of the workpiece.

8. The method of claim 7 which includes punching a pair of spaced holes downwardly through the workpiece after forging, each of said holes being located in respective crank arm portions of the workpiece.

* * * * *